US007300600B2

(12) United States Patent
Nishimura et al.

(10) Patent No.: US 7,300,600 B2
(45) Date of Patent: Nov. 27, 2007

(54) RARE EARTH BONDED MAGNET INCLUDING AMINO-ACID COMPOUND AS LUBRICANT

(75) Inventors: Shinsaku Nishimura, Iwata-gun (JP); Noboru Menjo, Iwata-gun (JP); Toshihiko Miura, Iwata-gun (JP)

(73) Assignee: Minebea Co., Ltd, Nagano (JP)

( * ) Notice: Subject to any disclaimer, the term of this patent is extended or adjusted under 35 U.S.C. 154(b) by 294 days.

(21) Appl. No.: 11/066,145

(22) Filed: Feb. 25, 2005

(65) Prior Publication Data

US 2005/0211947 A1 Sep. 29, 2005

(30) Foreign Application Priority Data

Mar. 26, 2004 (JP) ..... 2004-092241

(51) Int. Cl.
*H01F 1/08* (2006.01)
*C22C 38/00* (2006.01)

(52) U.S. Cl. ..... 252/62.55; 252/62.54; 148/104

(58) Field of Classification Search ..... 252/62.55, 252/62.54; 148/104
See application file for complete search history.

(56) References Cited

U.S. PATENT DOCUMENTS 6,001,272 A * 12/1999 Ikuma et al. ..... 252/62.54

FOREIGN PATENT DOCUMENTS

| | | | |
|---|---|---|---|
| JP | 02-158106 | * | 6/1990 |
| JP | A 11-45816 | | 2/1999 |
| JP | A 2000-36403 | | 2/2000 |

* cited by examiner

*Primary Examiner*—C. Melissa Koslow
(74) *Attorney, Agent, or Firm*—Oliff & Berridge, PLC

(57) ABSTRACT

In a rare earth bonded magnet comprising a mixture of rare earth magnetic powder, thermosetting resin, and lubricant, the lubricant is constituted by amino-acid compound, specifically either N-lauroyl-L-lysine or N-lauroyl-asparaginic acid. The content of the amino-acid compound as lubricant in the mixture is set to range between 0.01 wt % and 1.0 wt % of the magnetic powder. Since the amino-acid compound has a high decomposition point, the resultant magnet after heat-curing treatment has a sufficient mechanical strength. Also, the amino-acid compound is nonhygroscopic, and therefore oxidation resistance and humidity resistance are good enough. Further, since the amino-acid compound produces a small amount of outgas, the resultant magnet can be suitably and reliably used in a hard disk drive which has stringent requirements, especially on outgas.

7 Claims, No Drawings

RARE EARTH BONDED MAGNET INCLUDING AMINO-ACID COMPOUND AS LUBRICANT

BACKGROUND OF THE INVENTION

1. Field of the Invention

The present invention relates to a rare earth bonded magnet, and more specifically to a rare earth bonded magnet suitable for use in a hard disk drive.

2. Description of the Related Art

A rare earth bonded magnet is produced such that a mixture of rare earth magnetic powder and thermosetting resin such as epoxy resin (the mixture will hereinafter be referred to as "compound") is filled in a mold and compressed into a green compact, which is then heat-cured. Such a rare earth bonded magnet is required to fulfill industrial productivity, dimensional accuracy, and corrosion resistance as well as magnetic property, and when used in a spindle motor for a hard disk drive it is requested that outgas and other foreign particles be restrained and reduced which contaminate a recording medium. The magnetic property is influenced by the characteristic of magnetic powder, the proportion of magnetic powder and binder, and the compact density, and the industrial productivity is influenced by mechanical strength at the time of attachment to a motor. As for the corrosion resistance, good oxidation resistance and moisture resistance inhibit the magnetic property from degrading and the magnetic powder from shattering. Also, good corrosion resistance allows the thickness of coating to be reduced thereby enhancing the dimensional accuracy. And, in the aspect of moldability, the powder density, mold-fillability (flowability, uniform fillability), and mold-releasability are important factors. Among these factors, the powder density is crucial to producing a lengthy compact, and a compound with a higher powder density allows the filling depth into a mold to be reduced thereby ensuring the precision of the mold with less difficulty. Also, high fillability enables enhancement of the dimensional accuracy of a green compact, and application of a resultant magnet, for example, in a motor will reduce vibration.

It is known that a compound comprising only magnetic powder and thermosetting resin cannot achieve satisfactory moldability, and therefore metallic soap, for example, calcium stearate and zinc stearate, is conventionally applied as lubricant for enhancing moldability (refer to, for example, Japanese Patent Application Laid-Open No. H11-045816). When lubricant such as the aforementioned calcium stearate and zinc stearate is added to the compound, the mold-fillability (flowability, uniform fillability) and the mold-releasability are improved as well as the powder density is increased, and also, since the friction between the particles of the compound is reduced, the compressibility is improved, and there by the green compact density is increased. Fluorinated resin powder is proposed as an alternative lubricant (refer to, for example, Japanese Patent Application Laid-Open No. 2000-036403). Fluorinated resin has a high melting point (over 320 degrees C.) and does not melt when a green compact is subjected to heat-curing treatment thus having a deterrent effect on degradation in mechanical strength of a resultant product.

When the metallic soap such as the calcium stearate or the zinc stearate is used as lubricant as disclosed in the aforementioned Japanese Patent Application Laid-Open No. H11-045816, the lubricant melts at the time of heat-curing treatment because it has a melting point lower than the temperature (100 to 200 degrees C.) of the heat-curing treatment of thermosetting resin used in compression molding, which results in a significantly degraded mechanical strength of the resultant product compared when such a lubricant is not used. If a reduced amount of lubricant is added to prevent this problem, then satisfactory moldability, which is the very purpose in adding lubricant, cannot be achieved.

In a hard disk drive, a magnetic read/write head floats over a recording medium, and outgas and contaminations on the recording medium cause problems. Consequently, the specifications of a rare earth bonded magnet for use in a hard disk drive are stringent with respect to outgas and ion residue. It is difficult for a rare earth bonded magnet containing the fluorinated resin as lubricant as disclosed in the aforementioned Japanese Patent Application Laid-Open No. 2000-036403 to meet the stringent specifications with respect to outgas and ion residue for use in a hard disk drive, and its application scope is restricted.

SUMMARY OF THE INVENTION

The present invention has been made in light of the above circumstances, and it is an object of the present invention to provide a rare earth bonded magnet which satisfies requirements such as mechanical strength, moisture resistance, and outgas, without sacrificing its moldability, so as to be extensively used.

In order to achieve the object, according to one aspect of the present invention, a rare earth bonded magnet comprises a mixture of rare earth magnetic powder, thermosetting resin, and lubricant that is constituted by amino-acid compound. The amino-acid compound has an excellent lubricating ability and therefore contributes to improving the moldability, specifically increased powder density, enhanced mold-fillability and mold-releasability, and the like. Also, since the amino-acid compound has a decomposition point higher than the temperature (100 to 200 degrees C.) heat-curing treatment, the rare earth bonded magnet achieves a sufficient mechanical strength. Further, since the amid-acid compound is nonhygroscopic, the rare earth bonded magnet achieves sufficient oxidation resistance and humidity resistance.

In the one aspect of the present invention, the amino-acid compound may be N-lauroyl-L-lysine or N-lauroyl-asparaginic acid.

In the one aspect of the present invention, the content of the lubricant in the mixture may range from 0.01 wt % up to 1.0 wt % of the magnetic powder. If the content of the lubricant is less than the lower limit, the effect is small, and if the content of the lubricant is more than the upper limit, the resultant product does not achieve a sufficient mechanical strength.

In the one aspect of the present invention, the rare earth bonded magnet may be used in a hard disk drive. Since the amid-acid compound as lubricant generates outgas in a small amount, the rare earth bonded magnet is suitable for use in a hard disk drive which specifies stringent requirements, especially on outgas.

Thus, the rare earth bonded magnet according to the present invention uses amid-acid compound as lubricant and thereby is excellent in mechanical strength, humidity resistance, and outgas reduction, which expands the applicable scope of the rare earth bonded magnet

DETAILED DESCRIPTION OF THE PREFERRED EMBODIMENTS

The present invention will hereinafter be discussed. As described in the summary above, the rare earth bonded magnet according to the present invention is formed of a mixture of rare earth magnetic powder, thermosetting resin, and amino-acid compound as lubricant. The rare earth magnetic powder may have one of the following compositions (not limited thereto):

(1) a composition comprising base components: rare earth elements to principally contain Sm; and transition metal to principally contain Co (Sm—Co alloy powder);

(2) a composition comprising base components: R (R is at least one of rare earth elements to contain Y), transition metal to principally contain Fe, and B (R—Fe—B alloy powder);

(3) a composition comprising base components: rare earth elements to principally contain Sm, transition metal to principally contain Fe, and interstitial elements to principally contain N (Sm—Fe—N alloy powder);

(4) a composition comprising base components: R (R is at least one of rare earth elements to contain Y), and transition metal to contain Fe, and the like, and having a nano-sized magnetic layer (nanocrystal magnetic powder);

(5) a composition comprising a mixture of at least two of the compositions (1) to (4);

(6) a composition comprising a mixture of one of the compositions (1) to (4), and one of hard ferrite magnetic powders such as Ba ferrite, and Sr ferrite.

The average particle size of the above magnetic powder is not set to a specific value, but in case of a melt-spun ribbon of Nd—Fe—B alloy, the average particle size ranges preferably from 50 μm up to 300 μm. This is because if the average particle size measures less than 50 μm, the magnetic powder gets oxidized thereby degrading the magnetic properties, and if the average particle size measures more than 300 μm, the particle size of the compound becomes large thereby decreasing the fillability into a small space in a mold. The particle size distribution may be uniform or may be dispersed to some extent. In case of using a small amount of binding resin, the particle size distribution is preferably dispersed to some extent, that is to say, preferably has some variations, whereby the resultant bonded magnet has a reduced vacancy ratio. As for the compositions (5) and (6), the magnetic powders mixed may have respective average particle sizes and respective particle size distributions different from one another. When two or more magnetic powders having respective average particle sizes different from each other are mixed with each other, magnetic powder particles with a smaller size are adapted to get in between magnetic powder particles with a larger size, which results in an increased filling ratio thus contributing to improvement of the magnetic characteristics of the bonded magnet.

For the rare earth bonded magnet according to the present invention, epoxy resin may be used as thermosetting resin. The epoxy resin comprises base resin and curing agent, and may be a combination of any kinds thereof as long as curing reaction is developed when heat is applied. Also, the epoxy resin may be in the form of liquid, solid (including varnish form made by dilution in solvent, and powder form), or capsuled liquid. The magnetic powder and the thermosetting resin are mixed and granulated by various machines and methods applicable, for example, a Henschel mixer, a grinding mixer, a tumbled fluid bed granulation method, a pelletizing granulation method, or the like. The content of the thermosetting resin ranges preferably from 1.0 wt % up to 3.0 wt % of the magnetic powder. If the content of the thermosetting resin is less than 1.0 wt % of the magnetic powder, the resultant magnet has an insufficient strength, and if the content of the thermosetting resin is more than 3.0 wt % of the magnetic powder, the volume ratio of the magnetic powder decreases thus resulting in the resultant magnet having degraded magnetic characteristics.

As described above, amino-acid compound is used as lubricant in the present invention, specifically, N-lauroyl-L-lysine or N-lauroyl asparate-β-lauryl ester is preferable. The N-lauroyl-L-lysine is a stable white powder obtained from L-lysine of natural amino acid and lauric acid, has a decomposition point of 230 degrees C., is nearly insoluble in any organic solvent other than strong acid and weak alkaline, is nonhygroscopic, and provides an inorganic filler with water-shedding quality. Also, it is a soft organic substance having a low coefficient of friction and an excellent lubricity. N-lauroyl asparate-β-lauryl ester, like the aforementioned N-lauroyl-L-lysine, when added to an inorganic powder in a small amount, makes its surface hydrophobic thereby providing water-shedding quality, and improves the moldability of powder (increased powder density, and enhanced mold fillability and mold-releasability).

The lubricant is added to and mixed with the mixture of the magnetic powder and the thermosetting resin by a Henschel mixer, V-blender, or the like. The content of the lubricant ranges preferably from 0.01 wt % up to 1.0 wt % of the magnetic powder, more preferably from 0.05 wt % up to 0.3 wt %. When the content of the lubricant is increased, the powder density increases, the mold-fillability and the mold-releasability improve, the compact can be made longer, the dimensional accuracy improves, and also the friction between the particles of the compound decreases improving the compressibility resulting in a increased density of the resultant compact, but at the same time, the volume ratio of the magnetic powder decreases degrading the magnetic properties, and the mechanical strength of the compact after heat-curing treatment is degraded. Consequently, the upper limit of the content is preferably set to 1.0 wt %. And, when the content of the lubricant is less than 0.01 wt %, the moldability of the powder and the density of the compact are not ensured, and therefore the lower limit of the content is preferably set to 0.01 wt %.

The rare earth bonded magnet according to the present invention is formed such that the compound described above is molded. When the compound is compression-molded, the compound is filled in the mold of a compression molding machine and molded in a magnetic field (for example, a magnetic field of 400 kA/m to 1,600 kA/m oriented longitudinally, transversally, radially, or multi-pole anisotropically) or non-magnetic field under a compacting pressure ranging from 98 MPa to 1,960 MPa, preferably from 490 MPa to 1,470 MPa. A too low compacting pressure does not allow the compact to get a sufficient density, and a too high compacting pressure may damage the mold. The molding method is not limited to the compression molding, and may alternatively be an extrusion molding, an injection molding, or the like.

The green compact thus formed undergoes a heat-curing treatment in order to cure the thermosetting resin. The temperature, time, and method (constant or step heating) of the heat curing treatment may be optionally determined in accordance with the characteristic of the thermosetting resin. The heat-curing treatment may be conducted in the air, but preferably under nitrogen atmosphere to prevent the oxidization of the magnetic powder.

The rare earth bonded magnet may be corroded with rust and the like in the air depending on the environment. Therefore, the rare earth bonded magnet, when formed of corrosion-prone magnetic powder, is preferably provided with anticorrosive coat. The anticorrosive coat may be provided by spraying, electrodeposition, immersion, chemical vapor deposition, Ni-plating, or the like.

The configuration and dimension of the rare earth bonded magnet are not specifically defined. The magnet can be shaped, for example, cylindrical, rectangular columnar, arced, plate-like, and curved, and can be sized large or micro.

The rare earth bonded magnet according to the present invention has favorable magnetic properties, compact density, powder density, mold-releasability, and dimensional accuracy, and also is excellent in mechanical strength, outgas reduction, and moisture resistance. Especially, the excellence in outgas reduction makes the magnet perfect for use in a spindle motor for a hard disk drive which comes up with a stringent specification with regard to outgas and ion residue, and therefore the magnet can be reliably incorporated in a hard disk drive.

EXAMPLES

A melt-spun ribbon of Nd—Fe—B alloy was pulverized to be formed into rare earth magnetic powder with an average particle diameter of about 100 μm with its maximum not exceeding 300 μm. Solid epoxy resin (in the form of varnish) as thermosetting resin was added to the magnetic powder produced as described above in a amount of 2.0 wt % of the magnetic powder and was mixed by a grinding mixer. Then, various amounts of calcium stearate or N-lauroyl-L-lysine as lubricant were respectively added to the mixture of the magnetic powder and the epoxy resin and mixed by a V-blender thereby producing various compounds. The various compounds with respective lubricants were each filled in the cavity of a mold by a general method, and compressed at room temperature under a pressure of 980 MPa into respective green compacts shaped like rings, each of the green compacts having an outer diameter of 32 mm, an inner diameter of 30 mm, and a height of 4 mm. The ring-shaped green compacts were heat-cured at a temperature of 150 degrees C. for 1 hour under nitrogen atmosphere, and Samples 1 to 15 were produced, which include respective lubricant kinds and contents as shown in Table 1. The samples thus produced were not provided with coating, and examined and evaluated on magnetic property, compact density, mechanical strength, outgas, moisture resistance, compound powder density, mold-releasability, uniform mold-fillability, and dimensional accuracy.

The magnetic property was examined by a method of using a B—H curve tracer, and the mechanical strength was examined by a method of measuring radial crushing strength by a tension and compression testing machine. The outgas was measured by using a gas chromatograph for quantitative analysis of the amount of gas produced when the samples were heated at 85 degrees C. for 3 hours, and the moisture resistance was examined by visual observation of rust development on the samples put in a constant-temperature and -humidity bath with a temperature of 80 degrees C. and a humidity of 95% for 10 days. The mold-releasability was examined by visual observation of the compound remaining to stick on the upper and lower punches of the mold, and the uniform mold-fillability and the dimensional accuracy were examined by measuring the concentricity on the annular samples.

The results of the examinations are shown in Table 1. Sample 1 contains no lubricant, Samples 2 to 8 contain calcium stearate as conventionally, and Samples 9 to 15 contain N-lauroyl-L-lysine that is amino-acid compound.

TABLE 1

| Sample No | Lubricant | Content [wt %] | Magnetic property [kJ/m$^3$] | Molding density [Mg/m$^3$] | mechanical strength [Mpa] | Outgas [μg/g] | moisture resistance | Powder density [Mg/m$^3$] | Mold-releas-ability | Concentricity [μm] |
|---|---|---|---|---|---|---|---|---|---|---|
| 1 Comparative | None | — | 88 | 5.95 | 80 | 0.20 | Δ | 2.42 | X | 20 |
| 2 Comparative | Calcium stearate | 0.01 | 88 | 5.97 | 70 | 0.22 | Δ | 2.67 | ○ | 10 |
| 3 Comparative | Calcium stearate | 0.05 | 89 | 5.98 | 60 | 0.25 | Δ | 2.87 | ○ | 9 |
| 4 Comparative | Calcium stearate | 0.10 | 89 | 6.01 | 52 | 0.30 | Δ | 3.09 | ⊙ | 7 |
| 5 Comparative | Calcium stearate | 0.20 | 90 | 6.03 | 48 | 0.30 | Δ | 3.18 | ⊙ | 7 |
| 6 Comparative | Calcium stearate | 0.30 | 91 | 6.07 | 42 | 0.32 | Δ | 3.25 | ⊙ | 6 |
| 7 Comparative | Calcium stearate | 1.00 | 92 | 6.13 | 29 | 0.38 | Δ | 3.41 | ⊙ | 4 |
| 8 Comparative | Calcium stearate | 1.50 | 92 | 6.17 | 18 | 0.42 | Δ | 3.58 | ⊙ | 3 |
| 9 Comparative | N-lauroyl-L-lysine | 1.50 | 92 | 6.15 | 30 | 0.30 | ○ | 3.55 | ⊙ | 3 |
| 10 Inventive | N-lauroyl-L-lysine | 0.01 | 88 | 5.96 | 78 | 0.21 | ○ | 2.65 | ○ | 10 |
| 11 Inventive | N-lauroyl-L-lysine | 0.05 | 89 | 5.98 | 75 | 0.23 | ○ | 2.86 | ○ | 9 |
| 12 Inventive | N-lauroyl-L-lysine | 0.10 | 89 | 6.00 | 70 | 0.24 | ○ | 3.06 | ⊙ | 7 |
| 13 Inventive | N-lauroyl-L-lysine | 0.20 | 90 | 6.02 | 67 | 0.25 | ○ | 3.15 | ⊙ | 7 |
| 14 Inventive | N-lauroyl-L-lysine | 0.30 | 91 | 6.06 | 63 | 0.25 | ○ | 3.23 | ⊙ | 6 |
| 15 Inventive | N-lauroyl-L-lysine | 1.00 | 92 | 6.12 | 50 | 0.28 | ○ | 3.39 | ⊙ | 4 |

⊙ excellent,
○ good,
Δ poor,
X very poor,

Sample 1 with no lubricant has a high mechanical strength but is significantly inferior in other characteristics to the other samples containing lubricant, which indicates that lubricant is beneficial. Samples 10 to 15 are inventive samples containing N-lauroyl-L-lysine in amounts ranging 0.01 wt % to 1.0 wt % and are comparable in magnetic characteristic, compact density, powder density, mold-releasability, and concentricity to Samples 2 to 8 (comparative samples) but superior in mechanical strength, outgas, and moisture resistance. Sample 9 contains N-lauroyl-L-lysine in an amount of 1.5 wt % which is more than any of the contents for Samples 10 to 15, and has its mechanical strength lowered to 30 MPa resulting in an insufficient strength.

What is claimed is:

1. A rare earth bonded magnet comprising a mixture of rare earth magnetic powder, thermosetting resin, and lubricant, the lubricant being constituted by amino-acid compound, whereby the magnet produces a small amount of outgas.

2. A rare earth bonded magnet according to claim 1, wherein the amino-acid compound is one of N-lauroyl-L-lysine and N-lauroyl-asparaginic acid.

3. A rare earth bonded magnet according to claim 1, wherein a content of the lubricant in the mixture ranges between 0.01 wt % and 1.0 wt % of the magnetic powder.

4. A rare earth bonded magnet according to claim 2, wherein a content of the lubricant in the mixture ranges between 0.01 wt % and 1.0 wt % of the magnetic powder.

5. A hard disk drive comprising a rare earth bonded magnet according to claim 1.

6. A hard disk drive comprising a rare earth bonded magnet according to claim 2.

7. A hard disk drive comprising a rare earth bonded magnet according to claim 3.

* * * * *